US005399079A

United States Patent [19]

Peiz et al.

[11] Patent Number: 5,399,079

[45] Date of Patent: Mar. 21, 1995

[54] SICKLELESS INTERNAL GEAR PUMP WITH SEALING ELEMENTS INSERTED IN THE TOOTH HEADS

[75] Inventors: Peter Peiz; Franz Arbogast, both of Heidenheim, Germany

[73] Assignee: J. M. Voith GmbH, Heidenheim, Germany

[21] Appl. No.: 988,039

[22] Filed: Dec. 7, 1992

[30] Foreign Application Priority Data

Dec. 6, 1991 [DE] Germany ..... 41 40 293.6

[51] Int. Cl.[6] ..... F01C 1/10

[52] U.S. Cl. ..... 418/168; 418/140

[58] Field of Search ..... 418/125, 129, 140, 166, 418/168, 171

[56] References Cited

U.S. PATENT DOCUMENTS

| | | | |
|---|---|---|---|
| 2,866,417 | 12/1958 | Nubling | 103/126 |
| 4,008,017 | 2/1977 | Hennig et al. | 418/125 |
| 4,028,023 | 6/1977 | Labus | 418/108 |
| 4,840,550 | 6/1989 | Baumgartner et al. | 418/168 |
| 5,135,371 | 8/1992 | Arbogast et al. | 418/168 |

FOREIGN PATENT DOCUMENTS

| | | | |
|---|---|---|---|
| 4104397 | 9/1991 | Germany . | |
| 0404424 | 1/1934 | United Kingdom | 418/125 |
| 0220052 | 9/1968 | U.S.S.R. | 418/125 |

*Primary Examiner*—Richard A. Bertsch
*Assistant Examiner*—Charles G. Freay
*Attorney, Agent, or Firm*—Baker & Daniels

[57] ABSTRACT

The invention is directed to a sickleless internal gear pump including an internal ring gear and a pinion meshing with the ring gear. The internal ring gear and pinion having a common width and a plurality of teeth extending across the width. Each tooth has a tooth head with an involute profile. Each ring gear tooth includes a tooth head having a slot therein. The ring gear has a plurality of radial ports. A housing rotatably carries the internal ring gear and the pinion, and includes a suction port, a pressure port and an axial expanse corresponding to the teeth width. A plurality of sealing elements are respectively disposed in the ring gear tooth head slots. The sealing elements are radially movably disposed in the slots, and each sealing element defines an end face of the tooth head. The end face has an exterior profile corresponding to the involute profile. Each sealing element comprises a stop surface and a fixed stop. Each slot has a shape corresponding to and coacting with the stop surface and the fixed stop for limiting the radial movement of the sealing elements.

8 Claims, 1 Drawing Sheet

SICKLELESS INTERNAL GEAR PUMP WITH SEALING ELEMENTS INSERTED IN THE TOOTH HEADS

BACKGROUND OF THE INVENTION

The present invention concerns a sickleless internal gear pump having a ring gear and pinion for generating high pressure. A pump of this categorial design is known particularly as an embodiment from DE 41 04 397 A1.

Internal gear pumps generally feature an internal ring gear with which an external pinion with a smaller number of teeth is in mesh, i.e., engages the ring gear in driving fashion. Normally, the teeth of such pumps—based on the diameter of the pinion or ring gear—is relatively narrow so that—once the volume flow to be pumped has been determined by the height of the teeth and the width of the gears—this volume flow is for design reasons limited with popular pumps. Sickleless internal gear pumps specifically have the advantage of a minimal size.

For improving the tightness between the tooth heads of pinion and ring gear, DE 41 04 397 A1 already has proposed to insert a sealing element in each of the tooth heads of one of the two gears. These sealing elements are on the backside in contact with the pressure range so that, as the gears mesh, they bear in sealing fashion on the tooth head of always the other gear.

However, on the sickleless internal gear pump known from DE 41 04 397 A1, only a line seal is created in the area of pressure buildup on the tooth heads, according to the geometric shape of the sealing elements. With unfavorable conditions due to tolerance variations, spacing changes or variations of the internal diameter, as the case may be, a result of this is that the tightness of internal gear pumps is lacking. This is equivalent to a loss of pumped medium, a drop of the volumetric efficiency, an increase of pressure pulsation and, finally, an increase of the noise level of the pump in operation. The more favorable gap conditions required for a remedy in the area of the tooth head seal in the pressure buildup could be realized only at an extremely high manufacturing expense.

The problem underlying the present invention is to propose a sickleless internal gear pump of the categorial type where the sealing effect in the pressure buildup between opposed tooth heads of the gears is improved without causing the manufacturing expense to rise over proportionally, and with the result that the aforementioned shortcomings (pressure pulsation, noise) will be eliminated.

This problem is solved in that the sealing element is in the area of the sliding surface so dimensioned that it occupies the entire head surface of the tooth head of the ring gear or pinion.

The present invention is in the final analysis constituted by replacing the tooth heads of the ring gear or pinion quasi by an equivalent, i.e., equally acting insert which on grounds of its specific fashioning, or shaping, realizes in the pressure buildup area a surface seal, thereby ensuring a minimal gap between pinion head and ring gear head. This improves also the volumetric efficiency, with the final result that the internal gear pump is suited for elevated pressures. Likewise, the extreme efforts toward gap minimization as required in the manufacture or assembly of an internal gear pump are eliminated; eliminating for instance the joint finishing of the plain bearings of the bearing covers of an internal gear pump. In view of the production of ring gears it should be noted that the expensive and complex form grinding of the internal tooth head shape can be dispensed with, because that shape is realized by an insert which is manufactured separately, and thus more cost-effectively.

A particular advantage of the inventional concept is constituted in that, by way of the radial compensation achieved, a more suitable pressure buildup control is possible via control slots.

BRIEF DESCRIPTION OF HE DRAWINGS

The invention will be more fully explained hereafter with the aid of the drawing, which shows in FIG. 1, a cross section of a sickleless internal gear pump in the area of the two gears;

FIG. 2, an embodiment of a sealing element in conjunction with its installation in the tooth head of a ring gear.

DETAILED DESCRIPTION OF THE INVENTION

Figure 1:
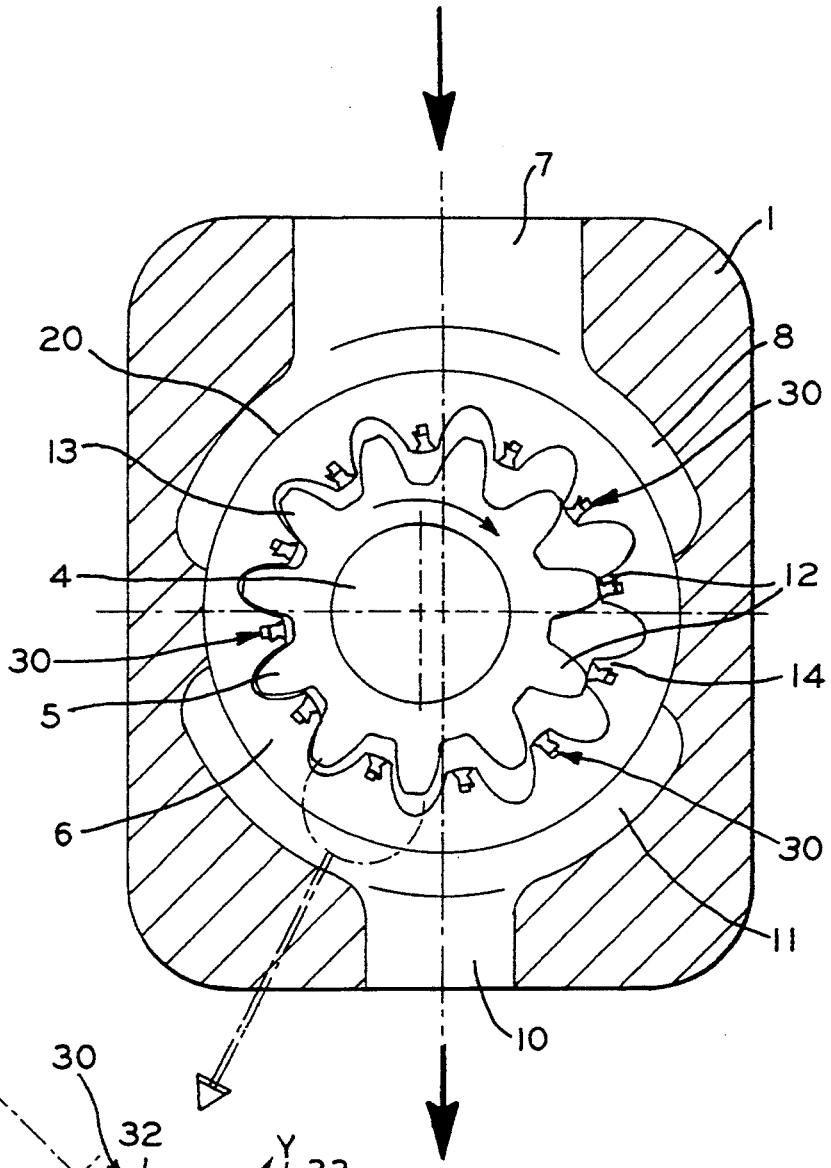

In cross section, FIG. 1 shows a sickleless internal, head-sealing gear pump which is subject to backlash and seals always with one flank, and at that, in the area of a housing center part 1 followed—viewed in axial direction—by further housing parts. The entire pump with the three housing parts has an overall axial length. An external pinion 5 fastened on a drive shaft 4 is in mesh with an internal ring gear 6. The teeth 12 of the pinion 5 and ring gear 6 have an axial width, and the pinion has a pitch circle diameter. The axial width of the gears is greater than the pitch circle diameter of the pinion. The pinion 5 and the ring gear 6 are not coaxial but installed eccentrically to one another; furthermore, the pinion 5 has one tooth less than the ring gear 6, so that the outside of a tooth head 13 on the pinion 5 always makes contact with the inside of a tooth head 14 on the ring gear 6. Visible, furthermore, is a suction port 7 in the zone where the teeth on the pinion 5, or ring gear 6, while rotating in the direction of arrow X, disengage. The suction port 7 in the housing center part 1, in which the ring gear 6 and pinion 5 are installed, is in axial direction followed, toward the adjacent housing parts, by a suction pocket 8 extending across part of the shell surface 20 of the ring gear 6. Originating as well from a pressure pocket 11 extending across a peripheral area on the ring gear, a pressure port 10 is located on the opposite side of the pump. The inflow of pressure medium to the interior of the pump, i.e., to the tooth spaces in the pinion 5 and ring gear 6 effecting the pumping of the pressure medium, takes place via—compare FIG. 2—radial ports 17 in the ring gear 6. These ports 17 originate from the shell surface 20 and empty in the tooth bottom of the ring gear 6.

The sickleless internal gear pump described so far pertains to the prior art.

As illustrated in FIG. 1, there are now—in a manner already known as such—sealing elements 30 inserted in the tooth heads of the ring gear 6, which sealing elements are specially designed and fitted, or held in place, according to the present invention. These inventional sealing elements 30 are illustrated, enlarged, in FIG. 2.

Figure 2:
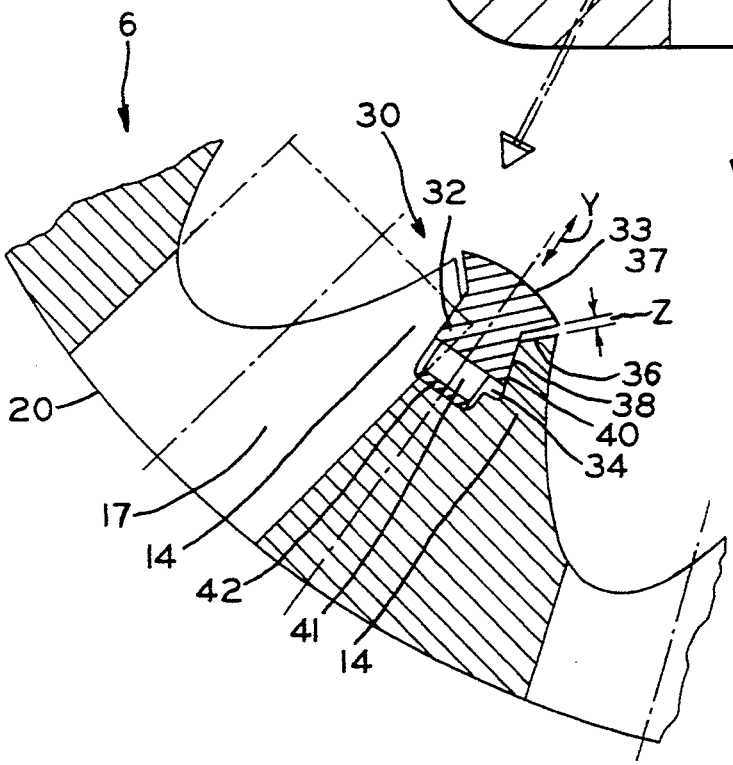

FIG. 2 shows a section of the ring gear 6 in the area of a tooth head 14. Viewed across the circumference of the ring gear 6, the ports 17 provided for the pressure medium inflow to the interior of the gear pump are machined in.

The sealing elements 30 are inserted each in the transition area between a port 17 and a tooth head 14, and at that, in such a way that an overlapping area (relief) 32 is created toward the port 17. The outer, or head end, end face 33 of the sealing element 30 is so fashioned that with a symmetric arrangement of the sealing element 30 relative to a tooth head 14 it corresponds exactly to its head set shape, i.e., to its symmetric ideal shape.

The sealing element 30 itself, as known as such, is mounted, or inserted, in radially movable fashion (refer to arrow Y) in a profiled slot 34 fashioned so as to complement the cross section of the sealing element 30, in the tooth head 14. This allows a radially directed displacement of the sealing element 30 in the profiled slot 34. The said radial displacement is limited on both sides, and at that, for one by a rim bordering on the rounded, or shaped, end face 33 and featuring a conjugate stop surface 37 of the sealing element 30 bearing on a complementary stop surface 36 of the tooth head 14; the second stop is realized by a formfitting fixed stop 38 of the foot part 39 of the sealing element 30 on the conjugate side surface 40 of the profiled slot 34. Between these two stops, the sealing element 30 can thus be moved radially to the extent of the gap width Z.

As follows from the illustration according to FIG. 2, the sealing element 30 has approximately the cross-sectional shape of a mushroom, with the lagging foot part, viewed in the direction of rotation X of the ring gear 6, flaring conically toward the shell surface 20. The said fixed stop 38 thus comes about by way of the complementary wall shape of the profiled slot 34.

Bordering on the foot of the sealing element 30 is an open space 41 which via the said relief 32, respectively the cut face, of the port 17, is open toward the pressure space of the pump. Created this way—viewed from the foot of the sealing element 30—is a connection that is open toward the pressure space and by way of which the sealing element 30 is pressurized as the gears rotate and by way of which the sealing element 30 can in the pressure buildup phase be forced on the pinion head 13 by the pressure. To prevent the sealing element 30 from lifting off the stop surface 36 in the suction phase of the internal gear pump, on account of centrifugal force, the foot of the sealing element 30 is opposed by a spring element in the channel 41, specifically an ondular shim 42.

The sealing element 30 taught above with the aid of FIG. 2, in the final analysis, must possess the following properties:

Since the line seal starts on the one head end and terminates after an approximately 40° angle of rotation on the other head end, the sealing element needs to be fitted across the entire head width.

The head shape corresponds to the geometry generated by the pinion head or ring gear head.

For a possible run-in phase, the element must be able to escape, requiring on both sides the presence of a limit stop in order to limit the run-in.

The material of the sealing element 30 must have good run-in properties, so that only nonferrous metal or fiber-reinforced plastic is suited as material.

In supplementation it should be noted that—viewed axially across a range of 360°—a guideway must be present for the sealing slats in order to prevent them from drifting sideways.

While the inventional sealing element 30 was taught above, with the aid of FIG. 2, only in conjunction with a ring gear 6, sealing elements meeting the specified conditions may as well be fitted in the pinion 5.

We claim:

1. A sickleless internal gear pump, comprising:

an internal ring gear and a pinion meshing with said ring gear, said internal ring gear and pinion having a common width and a plurality of teeth extending across said width, each said tooth having a tooth head with an involute profile, each said pinion tooth head being substantially the same each said ring gear tooth including a tooth head having an end face, a slot and a sealing element disposed in said slot, said sealing element radially movably disposed in said slot, said end face consisting of said sealing element, said end face having an exterior profile which is substantially identical to said involute profile of each said ring gear tooth head, each said sealing element comprising a stop surface and a fixed stop, each said slot having a shape corresponding to and coacting with said stop surface and said fixed stop for limiting said radial movement of said sealing elements, said ring gear having a plurality of radial ports; and a housing rotatably carrying said internal ring gear and said pinion, said housing having a suction port, a pressure port and an axial expanse corresponding to said teeth width.

2. The internal gear pump of claim 1, further comprising a plurality of ondular shims respectively disposed in each said slot for biasing the respective sealing element in a radially inward direction.

3. The internal gear pump of claim 2, wherein each said ondular shim is disposed on the radially outward side of said respective sealing element.

4. The internal gear pump of claim 2, wherein said slot and said sealing element define an open space on the radially outward side of said sealing element, said open space in fluid communication with a fluid pumped through said pump.

5. The internal gear pump of claim 2, wherein each said sealing element is made from one of non-ferrous metal and fiber-reinforced plastic.

6. The internal gear pump of claim 1, wherein each said sealing element is made from one of non-ferrous metal and fiber-reinforced plastic.

7. The internal gear pump of claim 1, wherein said slot and said sealing element define an open space on the radially outward side of said sealing element, said open space in fluid communication with a fluid pumped through said pump.

8. The internal gear pump of claim 7, wherein each said sealing element is made from one of non-ferrous metal and fiber-reinforced plastic.

* * * * *